US007379081B2

(12) United States Patent
Park et al.

(10) Patent No.: US 7,379,081 B2
(45) Date of Patent: May 27, 2008

(54) ORGANIC LIGHT EMITTING DIODE DISPLAY

(75) Inventors: Yong-Sung Park, Suwon-si (KR); Yojiro Matsueda, Suwon-si (KR); Sang-Moo Choi, Suwon-si (KR)

(73) Assignee: Samsung SDi Co., Ltd. (KR)

( * ) Notice: Subject to any disclaimer, the term of this patent is extended or adjusted under 35 U.S.C. 154(b) by 44 days.

(21) Appl. No.: 11/385,591

(22) Filed: Mar. 21, 2006

(65) Prior Publication Data

US 2006/0232183 A1 Oct. 19, 2006

(30) Foreign Application Priority Data

Apr. 13, 2005 (KR) ..... 10-2005-0030659

(51) Int. Cl.
*G09G 5/00* (2006.01)
*G09G 3/10* (2006.01)

(52) U.S. Cl. ..... 345/690; 315/169.2; 315/169.3

(58) Field of Classification Search ..... 345/77, 345/76, 39, 46, 55, 72, 82–84, 95, 204, 210, 345/212, 214, 690; 315/169.3, 169.1, 169.2, 315/291, 307; 313/504
See application file for complete search history.

(56) References Cited

U.S. PATENT DOCUMENTS

2005/0007392 A1* 1/2005 Kasai et al. ..... 345/690
2005/0093958 A1* 5/2005 Mori et al. ..... 347/207
2005/0156837 A1* 7/2005 Kasai ..... 345/77
2005/0269960 A1* 12/2005 Ono et al. ..... 315/169.3
2006/0202630 A1* 9/2006 Yamada ..... 315/169.2

FOREIGN PATENT DOCUMENTS

KR 10-2004-0103782 A 12/2004
WO WO 93/23972 11/1993

* cited by examiner

*Primary Examiner*—Thuy V. Tran
*Assistant Examiner*—Jimmy T Vu
(74) *Attorney, Agent, or Firm*—Knobbe Martens Olson & Bear LLP

(57) ABSTRACT

An OLED display comprising a plurality of pixels, first, second, and third reference voltage generators; and a data driver, all formed on the same substrate is disclosed. Each pixel includes a subpixel of a first color, a subpixel of a second color, and a subpixel of a third color. The first reference voltage generator generates first reference voltages corresponding to a subpixel of the first color, the second reference voltage generator generates second reference voltages corresponding to a subpixel of the second color, the third reference voltage generator generates third reference voltages corresponding to a subpixel of the third color, and the data driver converts digital video signals corresponding to the subpixels of the first, second, and third colors into data voltages, and transmits the data voltages to the subpixels of the first, second, and third colors, respectively.

18 Claims, 10 Drawing Sheets

ORGANIC LIGHT EMITTING DIODE DISPLAY

CROSS-REFERENCE TO RELATED APPLICATION

This application claims priority to and the benefit of Korean Patent Application No. 10-2005-0030659 filed in the Korean Intellectual Property Office on Apr. 13, 2005, the entire contents of which are incorporated herein by reference. This application is related to U.S. patent application Ser. No. 11/386,229, entitled "ORGANIC LIGHT EMITTING DIODE DISPLAY," filed concurrently herewith, the entire disclosure of which is incorporated herein by reference.

BACKGROUND OF THE INVENTION

1. Technical Field

The present disclosure relates generally to an organic light emitting diode (OLED) display, and more particularly, to a display device having a peripheral circuit and a display area formed on the same substrate.

2. Description of the Related Art

Active driving or active matrix is a well known method for driving an OLED display using active drive elements. Recently, thin film transistors (TFT) formed by deposition of an insulating substrate on a semiconductor layer has been used as the active drive element. In this way, TFTs have been formed on the insulating substrate to provide a circuit (e.g., driver) formed on an area other than the display area on the insulating substrate. A system formed with a display area and a peripheral circuit (e.g., a driver) together on an insulating substrate is referred to as a system-on-panel (SOP).

In the display device, gamma correction depends on the characteristics of a panel to which a video signal is input. Gamma correction is often a problem when the display device is an organic light emitting diode (OLED) display. An OLED display uses three different organic light emitting materials for each of the respective colors, red (R), green (G), and blue (B), because each organic light emitting material has different characteristics. Therefore, gamma correction is ideally independently applied for each of the R, G, B input signals.

The visibility of an image displayed by a light emitting display device is dependent on the brightness of the ambient environment. Ideally, the light emitting display device should output a brighter image when the ambient environment of the light emitting display device is bright, and output a darker image when the ambient environment of the light emitting display device is dark.

The brightness of an output image of the light emitting display device may be controlled by different methods depending on the brightness of the ambient environment, for example, by gamma correcting each color. However, conventional gamma correction methods use a common reference voltage without regard to the characteristics of the organic light emitting materials of the respective colors (R, G, and B), and accordingly, gamma characteristics cannot be accurately changed to correspond to changes in brightness of the ambient environment.

In the development of the SOP, many attempts have been made to form several circuits on the insulation layer together with the driver. To date, a gamma correction circuit has not been formed on the same insulating substrate.

The information disclosed in this Background section is provided only to enhance understanding the background of the invention and is not an admission that the information is prior art known in this country to a person of ordinary skill in the art.

SUMMARY OF CERTAIN INVENTIVE ASPECTS

Embodiments of the present invention provide an organic light emitting diode (OLED) display comprising a display area and gamma correction circuits for red, green, and blue colors on the same substrate, as well as methods for manufacturing the same.

In addition, some embodiments further provide an OLED display in which the brightness of the image varies with the brightness of the ambient environment.

An OLED display according to some embodiments includes a plurality of pixels, a first reference voltage generator, a second reference voltage generator, a third reference voltage generator, and a data driver, each formed on the same substrate. Each pixel includes a subpixel of a first color, a subpixel of a second color, and a subpixel of a third color. The first reference voltage generator generates a plurality of first reference voltages comprising a first highest reference voltage and a first lowest reference voltage, wherein the plurality of first reference voltages corresponds to a subpixel of the first color. The second reference voltage generator generates a plurality of second reference voltages comprising a second highest reference voltage and a second lowest reference voltage, wherein the plurality of second reference voltages corresponds to a subpixel of the second color. The third reference voltage generator generates a plurality of third reference voltages comprising a third highest reference voltage and a third lowest reference voltage, wherein the plurality of third reference voltages corresponds to a subpixel of the third color. The data driver converts digital video signals corresponding to the subpixels of the first, second, and third colors into data voltages based on the first, second, and third reference voltages, respectively, and transmits the data voltages to the subpixels of the first, second, and third colors, respectively.

In a further embodiment of the present invention, there is provided an organic light emitting diode (OLED) display including a plurality of pixels, a first resistor, a second resistor, a third resistor, a plurality of first reference voltage output terminals, a plurality of second reference voltage output terminals, a plurality of third reference voltage output terminals, and a data driver, each formed on the same substrate. Each pixel comprises a subpixel of a first color, a subpixel of a second color, and a subpixel of a third color. The first resistor comprises a resistive material formed on the substrate, a first highest reference voltage end, and a first lowest reference voltage end. The second resistor comprises a resistive material formed on the substrate, a second highest reference voltage end, and a second lowest reference voltage end. The third resistor comprises a resistive material formed on the substrate, a third highest reference voltage end, and a third lowest reference voltage end. The plurality of first reference voltage output terminals are coupled to the first resistor, and output a plurality of first reference voltages comprising a first highest reference voltage and a first lowest reference voltage. The plurality of second reference voltage output terminals are coupled to the second resistor, and output a plurality of second reference voltages comprising a second highest reference voltage and a second lowest reference voltage. The plurality of third reference voltage output terminals are coupled to the third resistor, and output a plurality of third reference voltages comprising a third highest reference voltage and a third lowest reference voltage. The data driver converts digital video signals for the first, second, and third subpixels into data voltages based on the first, second, and third reference voltages, respectively, and applies the data voltages to the subpixels of the first, second, and third colors, respectively.

DETAILED DESCRIPTION OF CERTAIN INVENTIVE EMBODIMENTS

Figure 1:
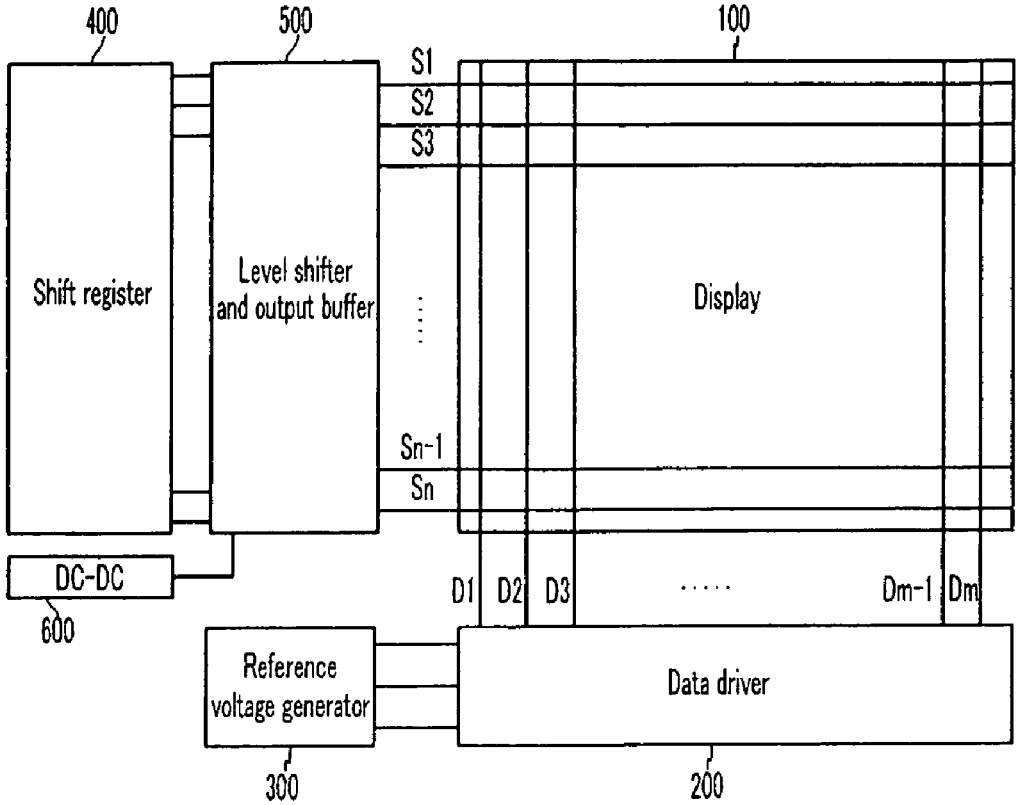
FIG. 1 is a top plan view of an organic light emitting diode (OLED) display according to an exemplary embodiment of the present invention.

In the following detailed description, only certain exemplary embodiments are shown and described, simply by way of illustration. As those skilled in the art would realize, the described embodiments may be modified in various ways, all without departing from the spirit or scope of the present invention. Accordingly, the drawings and description are to be regarded as illustrative in nature and not restrictive. Like reference numerals designate like elements throughout the specification.

An organic light emitting diode (OLED) display according to an exemplary embodiment of the present invention will now be described in more detail, and illustrated in FIG. 1, which is a schematic top plan view of an embodiment of an OLED display. As shown in FIG. 1, the OLED display includes a display 100, a data driver 200, a reference voltage generator 300, a shift register 400, a level shifter and output buffer 500, and a DC/DC converter 600, all of which are formed on the same substrate in the illustrated embodiment. The shift register 400, and the level shifter and output buffer 500 are also collectively referred to as a "scan driver."

The display 100 includes a plurality of scan lines S1-Sn elongated in a row direction and a plurality of data lines D1-Dm elongated in a column direction. A subpixel is formed at each intersection of one scan line S1-Sn and one data line D1-Dm. Each subpixel is addressed by the corresponding scan line and data line. A subpixel includes a pixel driving circuit and an organic light emitting diode (OLED). Typically, the pixel driving circuit comprises a thin film transistor (TFT). In addition, a subpixel selected according to a selection signal from the corresponding scan line and a data signal from the corresponding data line through the pixel driving circuit, emits light corresponding to the data signal through the OLED. Subpixels that emit red (R), green (G), and blue (B) light together form one pixel. In some embodiments, the subpixels are arranged in the form of a strip or a triangle in the display 100.

In the illustrated embodiment, the data driver 200 is arranged on one side of the display 100, and transmits data signals to the data lines D1-Dm. The data driver 200 is provided on one side of the display 100 in FIG. 1, but it may also be provided on two opposite sides of the display 100. When the data drivers are provided on the opposite sides of the display 100, in some embodiments, the video signal is divided into odd-numbered and even-numbered signals, which are applied by first and second data drivers, respectively. In this configuration, the first and second data drivers, respectively, transmit the odd-numbered and even-numbered data image signals to the display 100. Those skilled in the art will understand that other configurations of data drivers are also possible.

The reference voltage generator 300 generates a red reference voltage, a green reference voltage, and a blue reference voltage, and applies each reference voltage to a digital to analog converter of the data driver 200 for the respective colors. Hereinafter, red, green, and blue are referred to as "R," "G," and "B," and the digital to analog converter is referred to as a "DAC."

The shift register 400 sequentially outputs selection signals to the level shifter and output buffer 500, and the level shifter and output buffer 500 receives the selection signals from the shift register 400, changes a voltage level of the selection signal, and transmits the selection signal to the scan lines S1-Sn.

The DC/DC converter 600 generates a negative voltage and transmits the voltage to the level shifter and output buffer 500. A selection signal transmitted from the level shifter and output buffer 500 to the display 100 is typically a pulse signal that varies between positive and negative voltages.

Figure 2:
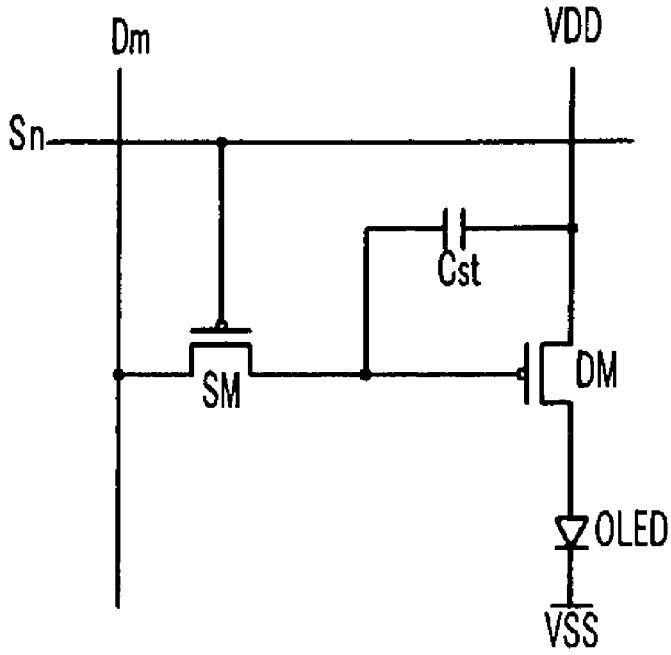
FIG. 2 is an equivalent circuit of a pixel according to an exemplary embodiment of the present invention.

An embodiment of a pixel circuit is schematically illustrated in FIG. 2, which illustrates an equivalent circuit of a pixel. In FIG. 2, a pixel circuit coupled to an n-th scan line Sn and an m-th data line Dm is shown for better understanding and ease of description. The illustrated pixel circuit uses an analog voltage (hereinafter, referred to as a "data voltage") as a data signal. In addition, a PMOS (positive channel MOS) transistor is used as a TFT in FIG. 2.

As shown in FIG. 2, the pixel circuit includes two TFTs (a switching transistor SM and a driving transistor DM), a capacitor Cst, and an OLED. A gate of the switching transistor SM is coupled to the scan line Sn and a source of the switching transistor SM is coupled to the data line Dm, and a drain of the switching transistor SM is coupled to a gate of the driving transistor DM. A source of the driving transistor DM is coupled to a source voltage VDD, and the capacitor Cst is coupled between the gate and source of the driving transistor DM. In addition, an anode of the OLED is coupled to a drain of the driving transistor DM, and a cathode of the OLED is coupled to a source voltage Vss that supplies a voltage lower than the source voltage VDD.

The following is description of an operation of the pixel circuit of FIG. 2. When a selection signal is applied to the scan line Sn, the switching transistor SM is turned on and a data voltage $V_{DATA}$ is transmitted to the driving transistor DM. At this time, a voltage corresponding to a voltage difference between the source voltage VDD and the data voltage $V_{DATA}$ is stored in the capacitor Cst such that a gate-source voltage $V_{GS}$ of the driving transistor DM is maintained for a given time period. In addition, the driving transistor DM applies a current $I_{OLED}$ at the gate-source voltage $V_{GS}$ to the OLED, thereby causing the OLED to emit light. In this state, the current $I_{OLED}$ flowing to the OLED is given as Equation 1.

$$I_{OLED} = \frac{\beta}{2}(V_{GS} - V_{TH})^2 = \frac{\beta}{2}(V_{DD} - V_{DATA} - |V_{TH}|)^2 \quad \text{(Equation 1)}$$

$V_{GS}$ is the gate-source voltage of the driving transistor DM, $V_{TH}$ is the threshold voltage of the driving transistor DM, $V_{DATA}$ is the data voltage, and β is a constant value. Notably, the current $I_{OLED}$ applied to the OLED increases as the data voltage $V_{DATA}$ decreases, and decreases as the data voltage $V_{DATA}$ increases according to Equation 1. Therefore, an image with a high grayscale is displayed when the data voltage is low whereas an image with a low grayscale is displayed when the data voltage is high in the organic light emitting display device. Equation 1 is satisfied when the driving transistor is a PMOS transistor. When the driving transistor is an NMOS transistor, the grayscale of the image is high when the data voltage is high and the grayscale of the image is low when the data voltage is low.

An embodiment of a manufacturing process of a SOP type of OLED display according to such an exemplary embodiment of the present invention will now be described. An amorphous silicon layer is deposited on an insulating substrate to form a channel layer of a TFT, the deposited amorphous silicon layer is transformed to a polysilicon layer through a low temperature polysilicon (LTPS) process, and the transformed polysilicon layer is patterned to form the channel of the thin film transistor. In the illustrated embodiment, the semiconductor channel layer formed in this step includes the channels of the TFTs of the display 100, the data driver 200, the reference voltage generator 300, the shift register 400, and the level shifter and output buffer 500. Subsequently, a first insulation layer is formed on the channel layer, a gate electrode and a metal layer for wiring are formed on the insulation layer, a second insulation layer is formed on the metal layer, and metal layers for drain and source electrodes and for an anode electrode of the OLED are sequentially formed on the second insulation layer. Subsequently, red, green, and blue OLEDs are formed as organic material layers, and transparent cathode electrodes are formed on the respective organic material layers.

The manufacturing process of a SOP described above uses a top gate TFT but those skilled in the art will also understand that other embodiments use a bottom gate TFT, and still other embodiments use a combination of top gate and bottom gate TFTs. The top gate and bottom gate TFTs are distinguished based on whether a gate electrode is formed on the top of the channel layer or at the bottom of the channel layer. Because the skilled technologist will be aware of various manufacturing processes of a SOP using a bottom gate TFT from the above description, the manufacturing process of the SOP OLED using a bottom gate TFT is not described in further detail.

A data driver according to an exemplary embodiment of the present invention will now be described in more detail with reference to FIG. 3, which is a schematic view of an embodiment of a data driver. In the embodiment illustrated in FIG. 3, the data driver includes a shift register 210, a sampling latch 220, a holding latch 230, a level shifter 240, and a DAC 250.

The shift register 210 generates a sampling signal from a start signal DSP according to clocks DCLK and DCLKB, sequentially shifts the sampling signal according to the clocks DCLK and DCLKB, and outputs a shifted result.

The sampling latch 220 includes a plurality of sampling circuits, each of which sequentially samples a red (R) digital signal, a green (G) digital signal, and a blue (B) digital signal input in accordance with the sampling signals sequentially transmitted from the shift register 210.

The holding latch 230 synchronously outputs the R, G, and B digital signals sequentially sampled by the sampling latch 220 according to an enable signal DENB.

The level shifter 240 changes voltage levels of the R, G, and B digital signals output from the holding latch 230 into voltage levels available to the DAC 250 according to an input voltage LVDD.

The DAC 250 converts the input R, G, and B digital signals into R, G, and B data voltages applied to the corresponding R, G, and B subpixels of the display 100, respectively. The DAC 250 uses reference voltages VR0-VR8, VG0-VG8, and VB0-VB8 generated by the reference voltage generator 300 for the conversion of the R, G, and B digital signals to the R, G, and B data voltages, respectively.

Gamma characteristics of R, G, and B subpixels; the reference voltage generator 300 (FIG. 1); and gamma correction by the DAC 250 on input image data and conversion of the gamma corrected image data into a reference voltage will now be described in more detail with reference to FIG. 4 to FIG. 10. The following description assumes that an input image data in FIG. 4 to FIG. 10 is a 6-bit digital signal, but those skilled in the art will understand that the method is also applicable to digital signals of other bit-widths.

Figure 4:
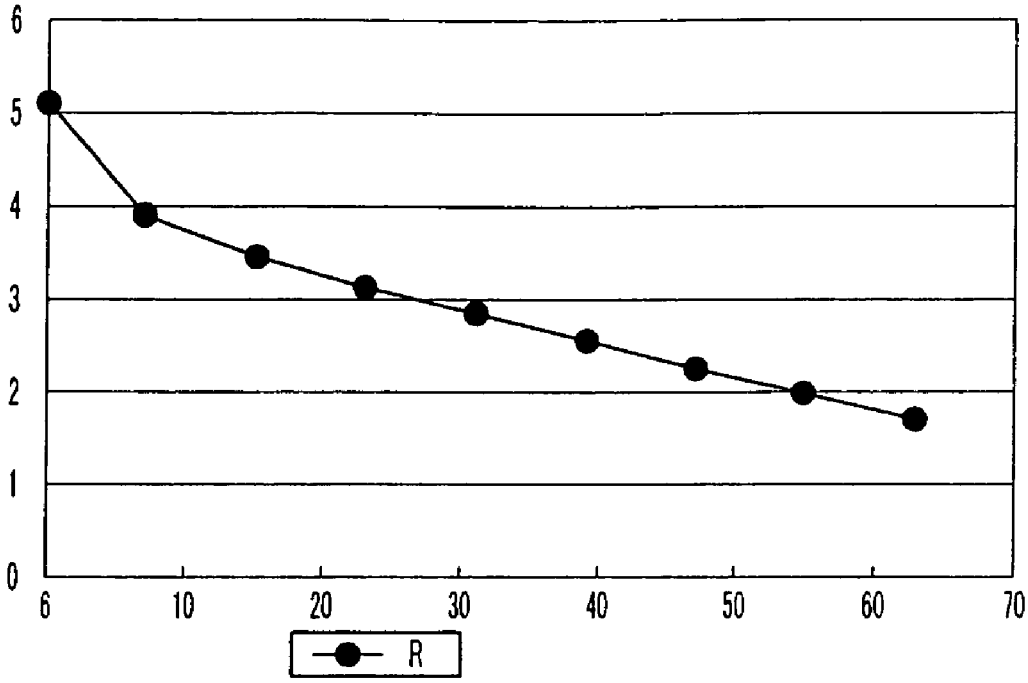
FIG. 4 is a graph showing an output data voltage of a digital to analog converter for a grayscale level of a red video signal.
Figure 5:
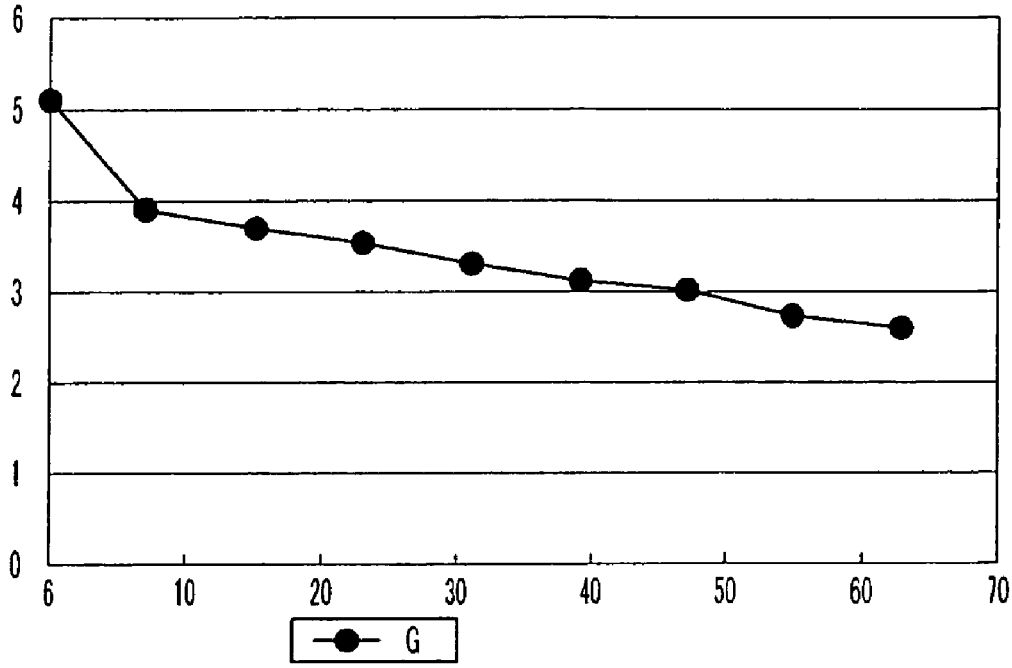
FIG. 5 is a graph showing an output data voltage of a digital to analog converter for a grayscale level of a green video signal.
Figure 6:
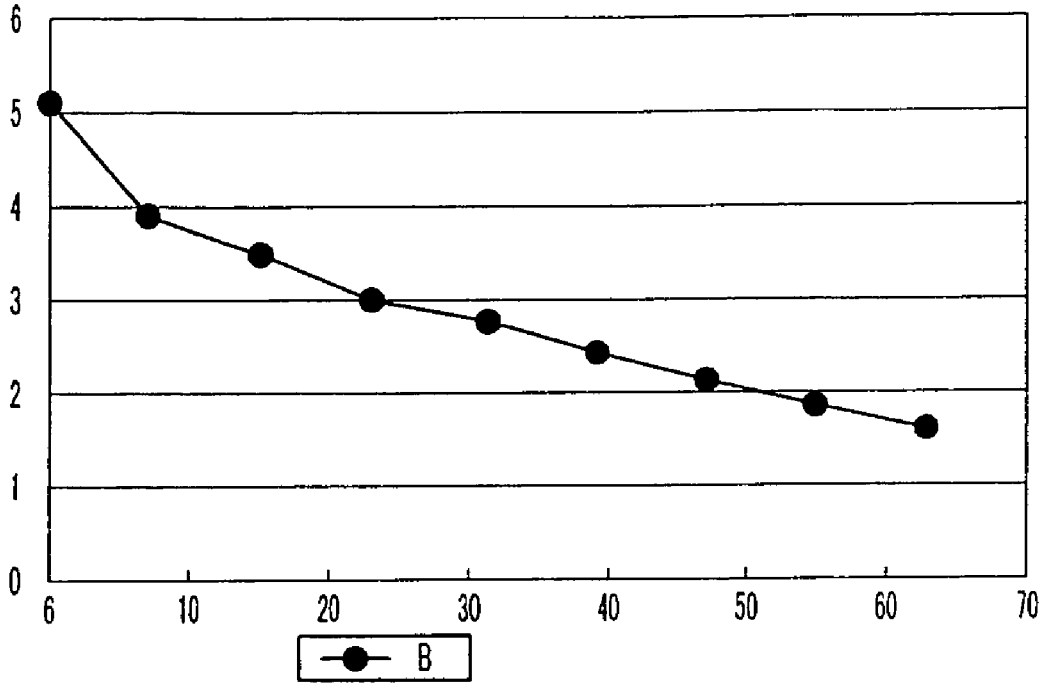
FIG. 6 is a graph showing an output data voltage of a digital to analog converter for a grayscale level of a blue video signal.

Gamma characteristics of R, G, and B subpixels will now be described with reference to FIG. 4 to FIG. 6. FIG. 4 to FIG. 6 respectively illustrate gamma characteristics of exemplary R, G, and B subpixels. In FIG. 4 to FIG. 6, horizontal axes represent grayscale levels of input image data and vertical axes represent data voltages applied to the respective R, G, and B subpixels to output the corresponding grayscale level.

As shown in FIG. 4 to FIG. 6, data voltages applied to the R, G, and B subpixels are different from each other for the same grayscale output. The gamma characteristics of the red, green, and blue colors differ because the organic light emitting materials for the respective red, green, and blue colors are different. Therefore, the gamma correction is performed for each color in consideration of the gamma characteristics of the respective color. In the illustrated embodiment, the reference voltage applied to the DAC 250 is separately determined for the respective colors.

As shown in FIG. 4 to FIG. 6, the 6-bit image data is divided into 8 fields, which are encoded by the three high-order bits. The reference voltage generator 300 (FIG. 1) supplies voltages that correspond to the lowest grayscale level and the highest grayscale level in each field as the reference voltage, and accordingly, nine reference voltages are supplied for the respective colors in each of eight fields.

A method for generating data voltages for the respective red, green, and blue subpixels using the DAC 250 will now be described in more detail. The DAC 250 receives a gamma corrected reference voltage from the reference voltage generator 300. Subsequently, the DAC 250 divides an input image data with given intervals according to grayscale levels. As described in greater detail below, when the input image data is 6-bit, the MSB decoder 251 decodes the three high-order bits and the LSB decoder 253 decodes the three low-order bits. The three high-order bits of the input image data encode eight grayscales. Therefore, 6-bit input image data is divided into eight fields corresponding to the eight grayscales. Synchronizing the ends of two adjacent fields forms nine boundary points: seven boundary points between the eight fields and the two end points of the first and last fields. The nine boundary points are set to the nine reference voltages input to the DAC 250 from the reference voltage generator 300, and the slope of each field is determined by the voltage differences of the nine boundary points. Then, graphs approximating the gamma correction curve using eight fields are formed as shown in FIG. 4 to 6. The grayscales of each field are subdivided by using the LSB decoder 253 and the resistor ladder 254 in substantially the same way.

Figure 7:
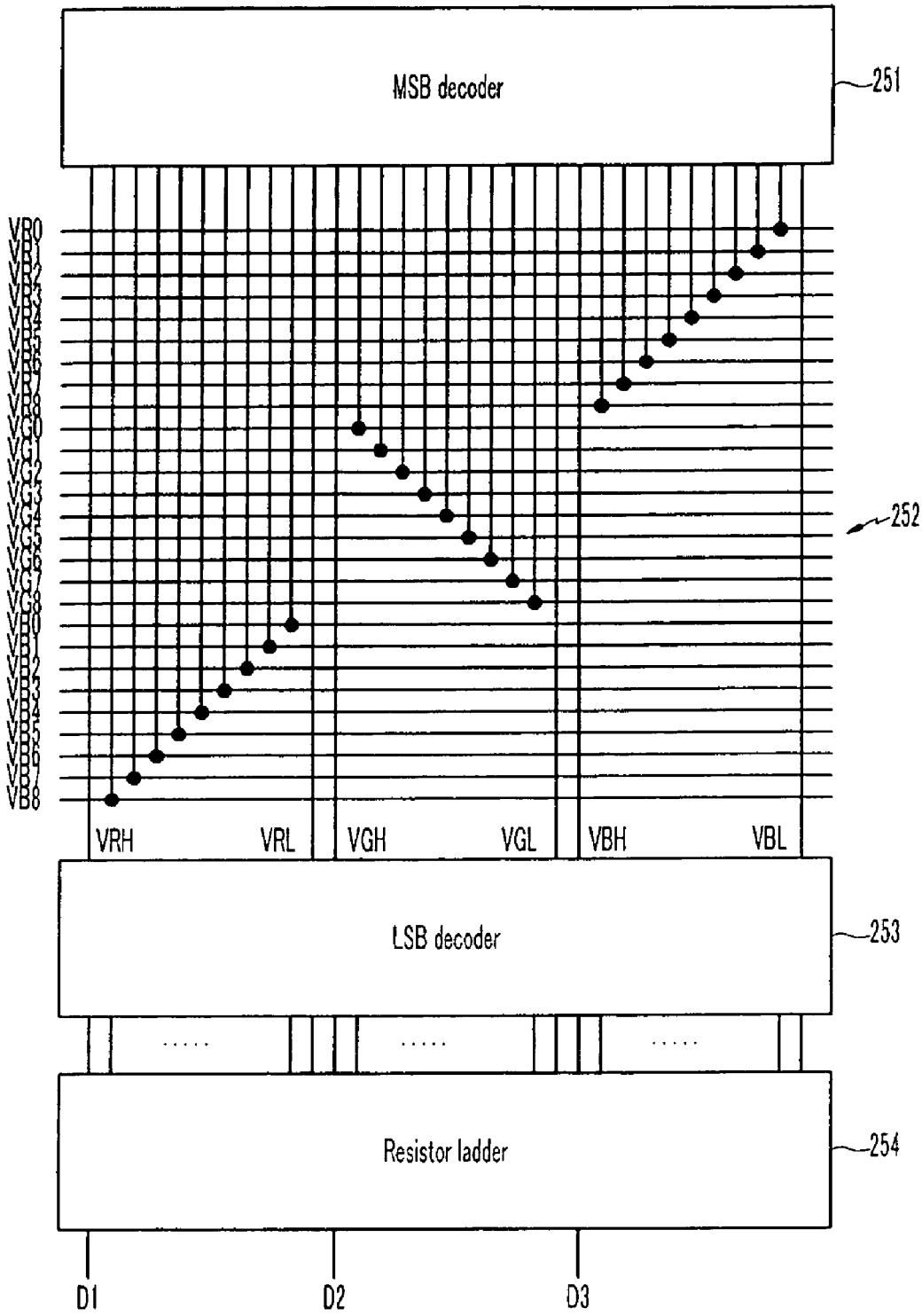
FIG. 7 is a schematic diagram of a digital to analog converter according to an exemplary embodiment of the present invention.
Figure 8:
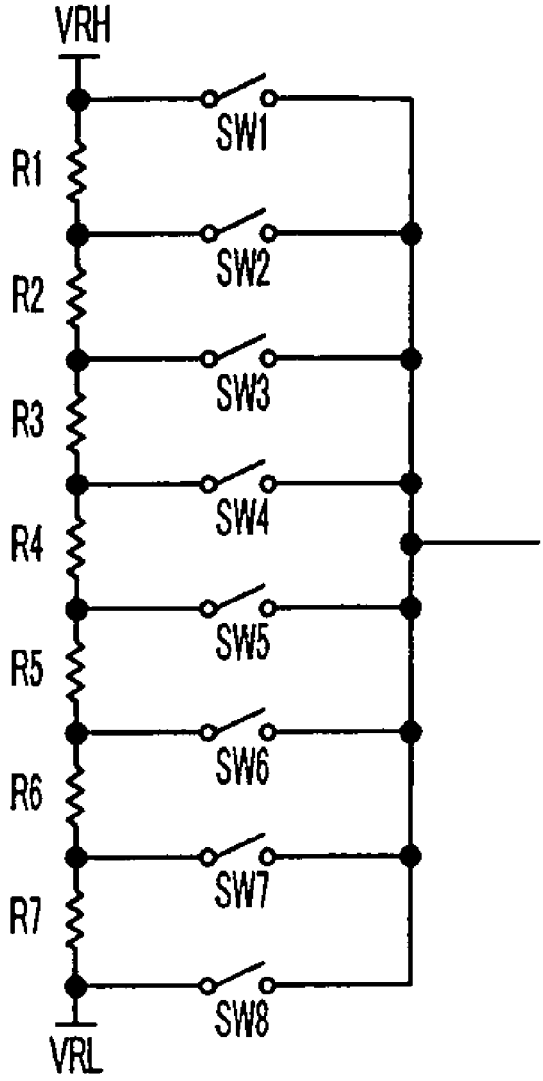
FIG. 8 is a schematic diagram of a resistor ladder and a least significant bit (LSB) decoder of a digital to analog converter.

FIG. 7 is a schematic view of a DAC 250 according to an exemplary embodiment of the present invention, and FIG. 8 is a schematic view of a resistor ladder 254 and a LSB decoder 253 illustrated in FIG. 7. The DAC 250 is formed of a plurality of DAC cells, corresponding to a plurality of data lines D1-Dm. FIG. 7 shows DAC cells corresponding to three of the data lines, D1-D3, for ease of understanding and description. In addition, the description assumes that the three data lines D1-D3 are coupled to columns of R, G, and B subpixels.

As shown in FIG. 7, the DAC 250 includes a most significant bit (MSB) decoder 251, a reference voltage wire unit 252, a least significant bit (LSB) decoder 253, and a resistor ladder 254. The MSB decoder 251 selects two consecutive reference voltages from the nine reference voltages VR0-VR8 and decodes the three high-order bits, while the LSB decoder 253 decodes the three low-order bits.

The reference voltage wire unit 252 includes nine horizontal wires transmitting R reference voltages VR0-VR8 input from the reference voltage generator 300 (FIG. 1), nine horizontal wires transmitting G reference voltages VG0-VG8, and nine horizontal wires transmitting B reference voltages VB0-VB8. Each wire is elongated in a horizontal direction in the illustrated embodiment. The reference voltage wire unit 252 further comprises vertical wires operatively coupling the nine horizontal wires to the MSB decoder 251.

Structural and operational features of the MSB decoder 251, the reference voltage wire unit 252, the LSB decoder 253, and the resistor ladder 254 will now be exemplarily described in more detail through a conversion process of R digital data to an R data voltage. In the illustrated embodiment, the MSB decoder 251 selects two consecutive horizontal wires among the respective nine horizontal wires according to the three high-order bits of the R digital data. Two vertical wires transmit reference voltages VRH and VRL from the two selected horizontal wires to the resistor ladder 254.

The resistor ladder 254 illustrated in FIG. 8 includes seven resistors R1-R7 coupled in series between the two reference voltages VRH and VRL of the MSB decoder 251 and the LSB decoder 253. Eight TFTs SW1-SW8 are arranged as illustrated: SW1 is coupled to a node between the reference voltage VRH and the resistor R1, SW2-SW7 are coupled to nodes between adjacent resistors R1-R7, respectively, and SW8 is coupled to a node between the resistor R7 and the reference voltage VRL. The LSB decoder 253 selects one TFT among the eight TFTs SW1-SW8 according to the three low-order bits of the R digital data, and outputs an R data voltage to the selected TFT. In the illustrated embodiment, the structure of the MSB decoder 251 is substantially similar to the LSB decoder 253 and is not further described.

Figure 9:
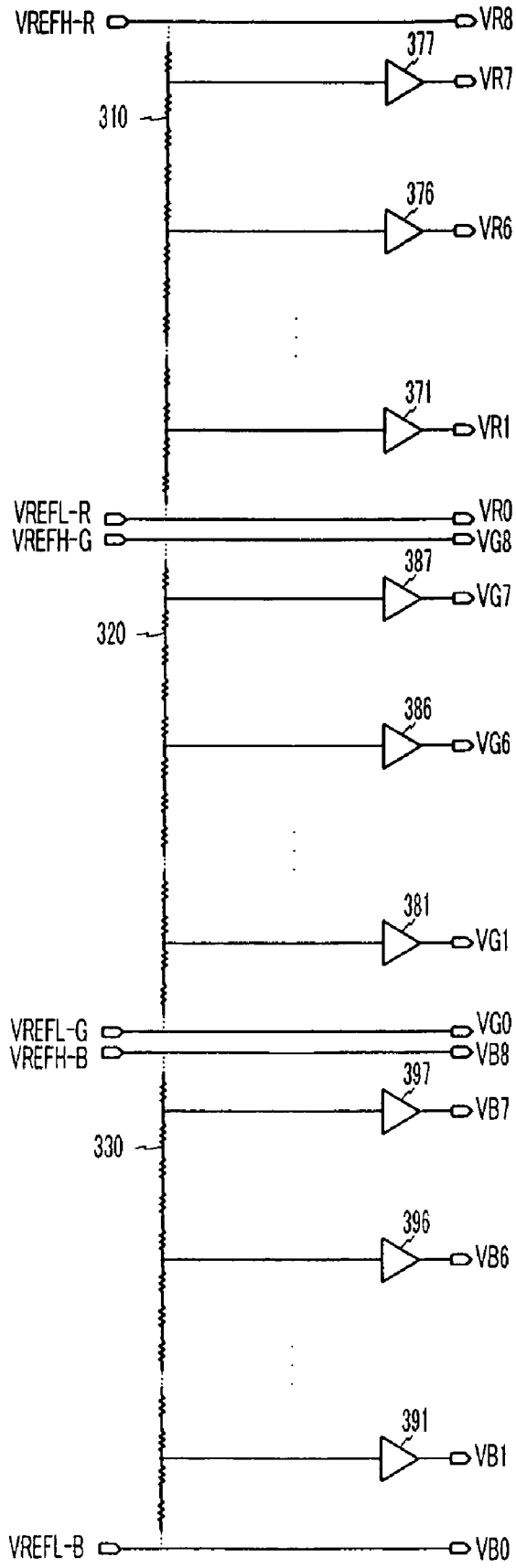
FIG. 9 is a schematic diagram of a voltage generator according to an exemplary embodiment of the present invention.

FIG. 9 schematically shows a reference voltage generator 300 according to an exemplary embodiment of the present invention. As shown in FIG. 9, the reference voltage generator 300 includes an R resistor ladder 310, a G resistor ladder 320, a B resistor ladder 330, R voltage buffers 371-377, G voltage buffers 381-387, and B voltage buffers 391-397.

The R resistor ladder 310, the G resistor ladder 320, and the B resistor ladder 330 each comprise a plurality of resistors in series. The resistor ladders are arranged in a vertical direction as shown in FIG. 9. However, in other embodiments, the R resistor ladder 310, the G resistor ladder 320, and the B resistor ladder 330 are superposed upon each other in a horizontal direction. When the R, G, and B resistor ladders 310, 320, and 330 are arranged in the horizontal direction, circuit wiring is more complex, but wiring space is saved. In some embodiments, the R resistor ladder 310, the G resistor ladder 320, and/or the B resistor ladder 330 are fabricated by forming a resistive material during a SOP manufacturing process. In some of these embodiments, the resistor ladders comprise electrical lines between which a resistive material is formed rather than a plurality of discrete resistors.

The first ends of the R, G, and B resistor ladders 310, 320, and 330 are operatively coupled with the highest reference voltages VREFH-R, VREFH-G, and VREFH-B, respectively. The second ends of the R, G, and B resistor ladders 310, 320, and 330 are operatively coupled to the lowest reference voltages VREFL-R, VREFL-G, and VREFL-B respectively. As described herein, the highest reference voltage VREFH-R, VREFH-G, and VREFH-B and the lowest reference voltage VREFL-R, VREFL-G, and VREFL-B are independently set depending on characteristics of organic light emitting materials of the respective colors, and consequently, are not necessarily the same for each color.

Each of the R resistor ladder 310, the G resistor ladder 320, and the B resistor ladder 330 include a plurality of output terminals. The plurality of output terminals are coupled to the resistor ladders and output reference voltages between the highest reference voltages for each color, VREFH-R, VREFH-G, and VREFH-B, respectively, and the lowest reference voltages for each color, VREFL-R, VREFL-G, and VREFL-B, respectively.

The plurality of output terminals coupled to the R resistor ladder 310, the G resistor ladder 320, and the B resistor ladder 330, respectively, correspond to the boundary points of the eight fields divided in accordance with the grayscale levels from the input image data as previously described. Consequently, each output terminal outputs the corresponding reference voltage. The respective output terminals divide the R resistor ladder 310, the G resistor ladder 320, and the B resistor ladder 330, respectively, into fields comprising a plurality of resistances. When the nine boundary points are selected, each of the highest reference voltages, VREFH-R, VREFH-G, and VREFH-B, and each of the lowest reference voltages, VREFL-R, VREFL-G, and VREFL-B, is provided with one output terminal. Each of the resistor ladders 310, 320, and 330 is provided with seven output terminals at positions corresponding to the reference voltages discussed above. In the illustrated embodiment, each resistor has a resistance selected to provide the respective reference voltage.

In the illustrated embodiment, the intermediate R, G, and B reference voltages are generated from the highest reference voltage and the lowest reference voltage of the respective colors, and accordingly, the DAC 250 (FIG. 3) controls a data voltage output to the display 100 (FIG. 1) by controlling the highest reference voltage and the lowest reference voltage of the respective colors input to the reference voltage generator 300 (FIG. 1). Therefore, when the highest and lowest reference voltages of the respective colors are increased, a data voltage applied to the display 100 (FIG. 1) is increased such that brightness of an image output from the OLED display is decreased. Similarly, when the highest and lowest reference voltages of the respective colors are decreased, the data voltage is increased such that the brightness of the image output from the OLED display is increased.

Referring to FIG. 9, the R voltage buffers 371-377, the G voltage buffers 381-387, and the B voltage buffers 391-397 are operatively coupled to the output terminals of the R resistor ladder 310, the G resistor ladder 320, and the B resistor ladder 330, respectively. The R voltage buffers 371-377, the G voltage buffers 381-387, and the B voltage buffers 391-397 function as buffers for the reference voltages of the colors generated and output from the R resistor ladder 310, the G resistor ladder 320, and the B resistor ladder 330, respectively.

Figure 10:
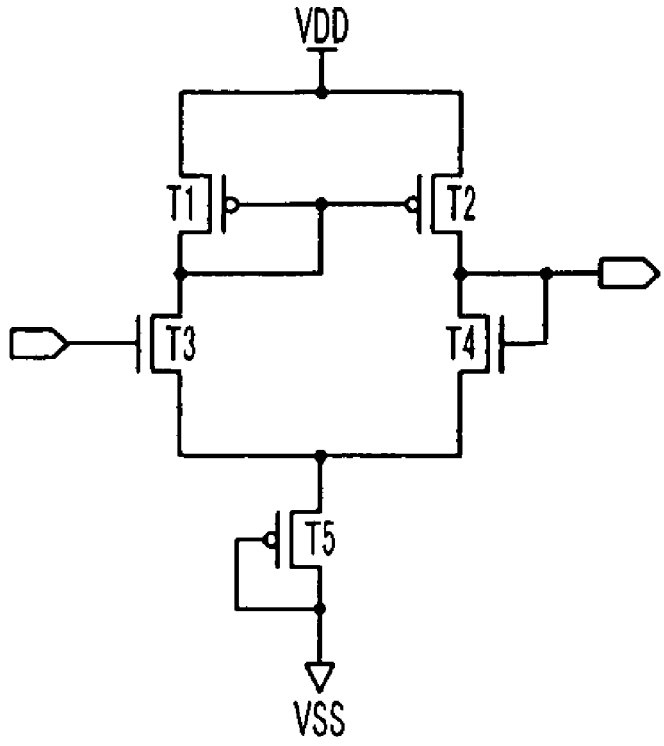
FIG. 10 is a circuit diagram of a voltage buffer in a voltage generator according to an exemplary embodiment of the present invention.

FIG. 10 illustrates an exemplary voltage buffer. As shown in FIG. 10, the voltage buffer includes TFTs T1-T5. In the illustrated embodiment, The transistors T1, T2, and T5 are PMOS transistors, and the transistors T3 and T4 are NMOS transistors. In some embodiments, the transistors T1 and T2 are the same size and have the same threshold voltages Vth, and the transistor T3 and T4 are the same size. As shown in FIG. 10, sources of the T1 and T2 are coupled to the source voltage VDD and gates of the transistors T1 and T2 are coupled to each other in a mirror image configuration. The source of the transistor T1 is coupled to a drain of the transistor T3, and the gate and drain of the transistor T1 are diode-connected. The source of the transistor T2 is coupled to a drain of the transistor T4 and an output terminal. A gate of the transistor T3 is accepts an input voltage, and the gate and drain of the transistor T4 are coupled to the output terminal. A source of the transistor T3 and the source of the transistor T4 are coupled to each other and to a source of the transistor T5. A drain of the transistor T5 is coupled to a voltage VSS, and a gate and a drain of the transistor T5 are diode-connected.

When a voltage output from the resistor ladders 310, 320, and 330 (FIG. 9) is applied to the gate of the transistor T3, the transistor T3 is turned on and a current flows through the transistors T1, T3, and T5. Because the transistors T1 are T2 are the same in size in the illustrated embodiment, and are coupled to each other in a mirror image configuration, the current flowing to the transistors T2 and T4 is the same as the current flowing to the transistors T1 and T3. In addition, since the transistors T3 and T4 are the same size, the gate voltage of the transistor T4 is the same as that of the transistor T3. Therefore, the output voltages of the voltage buffers 371-377, 381-387, and 391-397 are the same as output reference voltages of the resistor ladders 310, 320, and 330.

Figure 3:
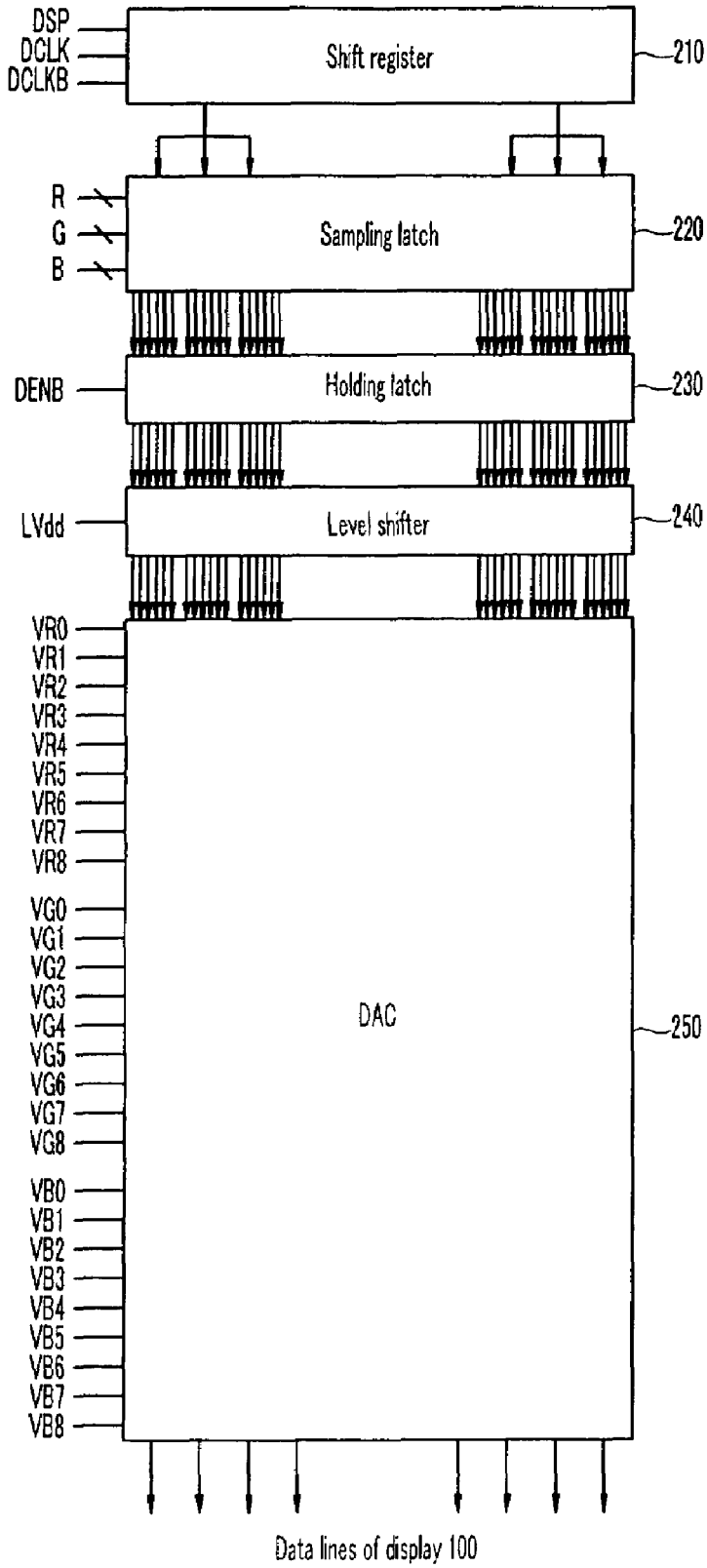
FIG. 3 is a schematic diagram of a data driver according to an exemplary embodiment of the present invention.

The reference voltage generator 300 (FIG. 1) generates R, G, and B reference voltages and transmits the voltages to the DAC 250 (FIG. 3). The DAC 250 generates R, G, and B data voltages from R, G, and B digital signals based on the R, G, and B reference voltages and applies the R, G, and B data voltages to the data line of each pixel of the display 100 (FIG. 1) of the OLED display according to some embodiments, wherein the R, G, and B reference voltage are independently gamma corrected for each color. Therefore, the OLED display displays an optimized image by performing gamma correction for each of the colors according to some embodiments.

In addition, the OLED display performs gamma correction optimized for the respective colors by using the highest and lowest reference voltages that are appropriate for the characteristics of light emitting materials of the respective colors used in the display 100, where the highest and lowest reference voltages of R, G, and B are different from each other according to some embodiments. In more detail, the OLED display displays an image that accounts for the brightness of the ambient environment of the OLED display by controlling the reference voltage generated from the reference voltage generator 300 in accordance with the brightness of the environment.

The OLED display according to some embodiments separately performs gamma correction on the respective colors. In more detail, the OLED display performs gamma correction appropriate for the particular characteristics of each color by selecting the most appropriate highest and lowest reference voltages. The organic light emitting materials for each color typically have different ranges of data voltages and gamma correction. In addition, the brightness of the displayed OLED varies with the ambient brightness. For example, when it is difficult to view the image because the ambient light is too bright, the OLED display decreases the data voltages by decreasing the highest and lowest reference voltages, thereby increasing brightness of the displayed image according to some embodiments. On the other hand, when the ambient light is low (e.g., in a dark room), the OLED display increases the data voltages, thereby decreasing the brightness of the image. In such a way, the OLED display dynamically monitors the ambient brightness and correspondingly controls the brightness of the image. Therefore, good visibility with reduced power consumption is realized by controlling the brightness of the image in accordance with the brightness of the ambient environment.

The present disclosure is not limited to the disclosed embodiments, but is intended to cover modifications and equivalent arrangements included within the spirit and scope of the appended claims.

What is claimed is:

1. An organic light emitting diode (OLED) display comprising:

a plurality of pixels formed on a substrate, wherein each pixel comprises a subpixel of a first color, a subpixel of a second color, and a subpixel of a third color;

a first reference voltage generator formed on the substrate, which generates a plurality of first reference voltages comprising a first highest reference voltage, and a first lowest reference voltage, wherein the plurality of first reference voltages corresponds to a subpixel of the first color;

a second reference voltage generator formed on the substrate, which generates a plurality of second reference voltages comprising a second highest reference voltage and a second lowest reference voltage, wherein the plurality of second reference voltages corresponds to a subpixel of the second color;

a third reference voltage generator formed on the substrate, which generates a plurality of third reference voltages comprising a third highest reference voltage and a third lowest reference voltage, wherein the plurality of third reference voltages corresponds to a subpixel of the third color; and a data driver formed on the substrate, wherein the data driver is configured to:

convert digital video signals corresponding to the subpixels of the first, second, and third colors into data voltages based on the first, second, and third reference voltages, respectively, and transmit the data voltages to the subpixels of the first, second, and third colors, respectively.

2. The OLED display of claim 1, wherein the first, second, and third reference voltages are data voltages corresponding to predetermined grayscales of the video signals for the subpixels of the first, second, and third colors, respectively.

3. The OLED display of claim 2, wherein the first, second, and third highest reference voltages are different from each other, and the first, second and third lowest reference voltages are different from each other.

4. The OLED display of claim 2, wherein the first, second, and third reference voltage generators comprise buffers coupled to output terminals.

5. The OLED display of claim 2, wherein the first, second, and third reference voltage generators divide the grayscales of the video signal into a plurality of groups based on at least one most significant bit, and sets a data voltage to the first, second, and third reference voltage, respectively, which correspond to a specific grayscale among a plurality of grayscales of the respective groups.

6. The OLED display of claim 5, wherein the specific grayscale is a grayscale corresponding to a boundary of each group.

7. The OLED display of claim 6, wherein the data driver comprises:

a first decoder selecting two first, two second, and two third reference voltages among the plurality of first, second, and third reference voltages;

a plurality of first resistors coupled in series between the two selected first reference voltages;

a plurality of second resistors coupled in series between the two selected second reference voltages;

a plurality of third resistors coupled in series between the two selected third reference voltages; and a second decoder selecting a node corresponding to the grayscale of the video signal among a plurality of nodes formed by the first, second and third resistors from bits of the grayscales of the video signal, excluding the at least one most significant bit.

8. The OLED display of claim 6, wherein the first, second, and third highest reference voltages are different from each other, and the first, second, and third lowest reference voltages are different from each other.

9. The OLED display of claim 6, wherein the first, second, and third reference voltage generators comprise buffers coupled to output terminals.

10. The OLED display of claim 5, wherein the data driver comprises:

a first decoder selecting two first, two second, and two third reference voltages from the plurality of first, second, and third reference voltages;

a plurality of first resistors coupled in series between the two selected first reference voltages;

a plurality of second resistors coupled in series between the two selected second reference voltages;

a plurality of third resistors coupled in series between the two selected third reference voltages; and a second decoder selecting a node corresponding to a gray scale of the video signal among a plurality of nodes formed by the first, second, and third resistors from bits of the grayscales of the video signal, excluding the at least one most significant bit.

11. The OLED display of claim 5, wherein the first, second, and third highest reference voltages are different from each other, and the first, second, and third lowest reference voltages are different from each other.

12. The OLED display of claim 5, wherein the first, second, and third reference voltage generators comprise buffers coupled to output terminals.

13. The OLED display of claim 1, wherein the first, second, and third highest reference voltages are different from each other, and the first, second, and third lowest reference voltages are different from each other.

14. The OLED display of claim 1, wherein the first, second, and third reference voltage generators comprise buffers coupled to output terminals.

15. An organic light emitting diode (OLED) display comprising:

a plurality of pixels formed on a substrate, wherein each pixel comprises a subpixel of a first color, a subpixel of a second color, and a subpixel of a third color;

a first resistor comprising a resistive material formed on the substrate, a first highest reference voltage end, and a first lowest reference voltage end;

a second resistor comprising a resistive material formed on the substrate, a second highest reference voltage end, and a second lowest reference voltage end;

a third resistor comprising a resistive material formed on the substrate, a third highest reference voltage end, and a third lowest reference voltage end;

a plurality of first reference voltage output terminals coupled to the first resistor and outputting a plurality of first reference voltages comprising a first highest reference voltage and a first lowest reference voltage;

a plurality of second reference voltage output terminals coupled to the second resistor and outputting a plurality of second reference voltages comprising a second highest reference voltage and a second lowest reference voltage;

a plurality of third reference voltage output terminals coupled to the third resistor and outputting a plurality of third reference voltages comprising a third highest reference voltage and a third lowest reference voltage; and a data driver formed on the substrate, wherein the data driver is configured to:

convert digital video signals for the first, second, and third subpixels into data voltages based on the first, second, and third reference voltages, respectively, and apply the data voltages to the subpixels of first, second, and third colors, respectively.

16. The OLED display of claim 15, wherein the first, second, and third reference voltages are data voltages corresponding to predetermined grayscales of the video signals for the subpixels of the first, second, and third colors, respectively.

17. The OLED display of claim 15, wherein the data driver comprises:

a first decoder selecting two first, two second, and two third reference voltages from the plurality of the first, second, and third reference voltages;

a plurality of first resistors coupled in series between the two selected first reference voltages;

a plurality of second resistors coupled in series between the two selected second reference voltages;

a plurality of third resistors coupled in series between the two selected third reference voltages; and a second decoder selecting a node corresponding to a grayscale of the video signal among nodes formed by the first, second, and third resistors from bits of the grayscales of the video signal, excluding the at least one most significant bit.

18. The OLED display of claim 15, wherein the first, second, and third highest reference voltages are different from each other, and the first, second, and third lowest reference voltages are different from each other.

* * * * *